US007248255B2

(12) United States Patent
Yoshida

(10) Patent No.: US 7,248,255 B2
(45) Date of Patent: Jul. 24, 2007

(54) ACTIVE DRIVE TYPE LIGHT EMITTING DISPLAY DEVICE AND DRIVE CONTROL METHOD THEREOF

(75) Inventor: Takayoshi Yoshida, Yonezawa (JP)

(73) Assignee: Tohoku Pioneer Corporation, Tendo-shi (JP)

( * ) Notice: Subject to any disclaimer, the term of this patent is extended or adjusted under 35 U.S.C. 154(b) by 577 days.

(21) Appl. No.: 10/770,394

(22) Filed: Feb. 4, 2004

(65) Prior Publication Data

US 2004/0160395 A1 Aug. 19, 2004

(30) Foreign Application Priority Data

Feb. 19, 2003 (JP) ..... 2003-040811

(51) Int. Cl.
*G09G 5/00* (2006.01)

(52) U.S. Cl. ..... 345/204; 345/76

(58) Field of Classification Search ..... 345/36, 345/39, 45, 76, 48, 82, 84, 204
See application file for complete search history.

(56) References Cited

U.S. PATENT DOCUMENTS 4,782,340 A * 11/1988 Czubatyj et al. ..... 345/92
5,952,789 A * 9/1999 Stewart et al. ..... 315/169.4
6,943,759 B2 * 9/2005 Tam ..... 345/76
7,042,427 B2 * 5/2006 Inukai ..... 345/77
7,079,092 B2 * 7/2006 Tanghe et al. ..... 345/76
2002/0021293 A1 * 2/2002 Tam ..... 345/204
2002/0047565 A1 * 4/2002 Nara et al. ..... 315/169.3
2003/0234755 A1 * 12/2003 Koyama ..... 345/82
2004/0041756 A1 * 3/2004 Henmi et al. ..... 345/76
2004/0263445 A1 * 12/2004 Inukai et al. ..... 345/82
2005/0024298 A1 * 2/2005 Tam ..... 345/76

FOREIGN PATENT DOCUMENTS

JP 7-36409 2/1995

* cited by examiner

*Primary Examiner*—Richard Hjerpe
*Assistant Examiner*—Jean Lesperance
(74) *Attorney, Agent, or Firm*—Westerman, Hattori, Daniels & Adrian, LLP.

(57) ABSTRACT

In a light emitting display device which is actively driven by TFTs, light emitting display pixels are driven efficiently. In a light emitting display panel 10, a large number of light emitting display pixels 10*a* are arranged in a matrix pattern and measuring pixels 10*b* are arranged forming a line along one dataline. A constant current is supplied from a constant current source 11 to the measuring pixels 10*b*, and the forward voltage VF of the EL element in the measuring pixel 10*b* is obtained by a voltage detecting terminal 12. The value of the drive voltage supplied to the light emitting display pixels 10*a* is controlled based on the forward voltage VF. Thus, a drive TFT (Tr2) constructing the light emitting display pixel 10*a* can drive an EL element E1 in the state where a drop voltage (VD) of the degree by which a constant current characteristic can be ensured is ensured, and a power loss generated in the drive TFT can be effectively restrained.

13 Claims, 3 Drawing Sheets

ACTIVE DRIVE TYPE LIGHT EMITTING DISPLAY DEVICE AND DRIVE CONTROL METHOD THEREOF

BACKGROUND OF THE INVENTION

1. Field of the Invention

The present invention relates to an active drive type light emitting display device provided with measuring pixels in addition to light emitting display pixels, and particularly to a light emitting display device and a drive control method thereof in which the light emitting display pixels can be efficiently driven by obtaining forward voltages of light emitting elements by means of the measuring pixels.

2. Description of the Related Art

A display using a display panel which is constructed by arranging light emitting elements in a matrix pattern has been developed widely. As the light emitting element employed in such a display panel, an organic EL (electroluminescent) element in which an organic material is employed in a light emitting layer has attracted attention. This is because of backgrounds one of which is that by employing, in the light emitting layer of an EL element, an organic compound which enables an excellent light emitting characteristic to be expected, a high efficiency and a long life have been achieved which make an EL element satisfactorily practicable.

The organic EL element can be electrically represented by an equivalent circuit as shown in FIG. 1. That is, the organic EL element can be replaced by a structure composed of a parasitic capacitance element Cp and a diode element E which is coupled in parallel to this capacitance element, and the organic EL element has been considered as a capacitor like light emitting element. When a light emission driving voltage is applied to this organic EL element, first, electrical charges corresponding to the electric capacity of this element flow into an electrode as a displacement current and are accumulated. Then, it can be considered that when the voltage exceeds a determined voltage (the light emission threshold voltage=Vth) peculiar to the element in question, current begins to flow from the electrode (anode side of the diode element E) to an organic layer constituting the light emitting layer so that the element emits light at an intensity proportional to this current. FIG. 2 shows light emission static characteristics of such an organic EL element. According to these, the organic EL element emits light at an intensity (L) approximately proportional to a drive current (I) as shown in FIG. 2A and emits light while the current (I) flows drastically when the drive voltage (V) is the light emission threshold voltage (Vth) or higher as shown by the solid line in FIG. 2B. In other words, when the drive voltage is the light emission threshold voltage (Vth) or lower, current rarely flows in the EL element, and the EL element does not emit light. Therefore, the EL element has an intensity characteristic that in a light emission possible region in which the voltage is higher than the threshold voltage (Vth), the greater the value of the voltage (V) applied to the EL element becomes, the higher the light emission intensity (L) of the EL element becomes as shown by the solid line in FIG. 2C.

Meanwhile, it has been known that physical properties of the organic EL element change and its forward voltage (VF) becomes higher due to use over a long period of time. Thus, with respect to the organic EL element, as shown in FIG. 2B, the V-I characteristic changes in the direction shown by the arrow (a characteristic shown by the broken lines) by a real use time, and therefore the intensity characteristic is also deteriorated. The organic EL element also has a problem that variations in initial intensities occur for example also due to variations in deposition at the time of forming a film of the element, whereby it becomes difficult to express an intensity gradation faithful to an input video signal.

Moreover, it has also been known that the intensity characteristic of the organic EL element changes approximately as shown by broken lines in FIG. 2C by temperature. That is, the EL element has a characteristic that in the light emission possible region in which the voltage is higher than the light emission threshold voltage, the greater the value of the voltage (V) applied to the EL element becomes, the higher the light emission intensity (L) thereof becomes, however, the higher the temperature, the lower the light emission threshold voltage becomes. Accordingly, the EL element becomes in a state where light of the EL element can be emitted by a lower applied voltage as the temperature becomes higher, and thus the EL element has a temperature dependency of the intensity that the EL element is brighter at a high temperature and is darker at a lower temperature though the same light emission possible voltage is applied.

In general, a constant current drive is performed for the organic EL element due to the reason that the voltage vs. intensity characteristic is unstable with respect to temperature changes although the current vs. intensity characteristic is stable with respect to temperature changes, the reason that it is necessary to prevent the element being deteriorated by an excess current, and the like. In this case, the drive voltage (VO), which is, for example, brought from a DC/DC converter and the like, supplied to a constant current circuit, has to be set considering respective elements as follows.

That is, as such elements, it is possible to enumerate the forward voltage (VF) of the EL element, a variation part (VB) of the VF of the EL element, a variation part per hour (VL) of the VF, a temperature change part (VT) of the VF, a drop voltage (VD) which is necessary for the constant current circuit performing the constant current operation, and the like. In the case where these elements synergistically affect also, in order that the constant current characteristic of the constant current circuit can be satisfactorily ensured, the drive voltage (VO) has to be set at a value obtained by summing maximum values of respective voltages shown as the respective elements.

However, the case where the voltage value obtained by summing the maximum values of the respective voltages as described above is required as the drive voltage (VO) supplied to the constant current circuit hardly occurs, and in a normal state, a large power loss is caused as a voltage drop part in the constant current circuit. Accordingly, this becomes a main cause of generation of heat, whereby stress is put on the organic EL element, peripheral circuit components, and the like. Japanese Patent Application Laid-Open No. H7-36409 (paragraph 0007 and thereafter and FIG. 1) discloses a structure in which the forward voltage VF of the EL element is measured so that the value of the drive voltage (VO) supplied to the constant current circuit is controlled based on this VF to solve the above-described problems.

The structure disclosed in the Japanese Patent Application Laid-Open No. H7-36409 shows a so-called passive matrix type display device in which respective EL elements are arranged at intersection point positions between respective anode rays and cathode rays. With such a passive matrix type display device, since constant current circuits are equipped for the respective anode rays in the anode drive, it is possible to easily pick up a mean value of the forward voltages VF of the respective EL elements connected to said anode rays by detecting the voltage value of one anode ray.

However, in an active matrix type display device, since active elements constituted by TFTs (thin film transistors) are added to respective EL elements arranged in a matrix pattern to operate the respective EL elements by constant current drive using these TFTs, in order to detect the forward voltages VF of the respective EL elements, it is necessary to draw VF detecting wiring lines from the respective EL elements, for example, from the anode terminals thereof. At this time, in the case of the structure in which drive voltages given to the respective pixels are controlled, for example, by utilizing the forward voltage VF of only one EL element, in the case where a trouble occurs in said EL element for which the forward voltage VF is measured, the entire body including the display panel and module substantially becomes defective. Thus, although a structure can be considered wherein respective VF detecting wiring lines are drawn from a plurality of EL elements so as to measure the mean value of the forward voltages VF of the respective elements, this structure causes physical problems such as a problem that the number of drawn wiring lines increases, whereby realization is difficult.

SUMMARY OF THE INVENTION

The present invention has been developed as attention to the above-described problems in the active matrix type drive circuit has been paid, and it is an object of the present invention to provide an active drive type light emitting display device and a drive control method thereof which enables forward voltages by a plurality of EL elements to be rationally picked up so that the drive voltage supplied to light emitting display pixels can be controlled based on this forward voltages.

An active drive type light emitting display device according to the present invention which has been developed in order to carry out the object described above is, as described in a first aspect, an active drive type light emitting display device in which a large number of light emitting display pixels each of which at least comprises a light emitting element and a drive TFT imparting a drive current to said light emitting element are arranged, characterized in that the active drive type light emitting display device is constructed in such a way that a plurality of measuring pixels each of which at least comprising a measuring element and a drive TFT imparting a drive current to said measuring element are further arranged in the light emitting display device so that a forward voltage of the measuring element constructing the measuring pixel can be picked up.

A drive control method for an active drive type light emitting display device according to the present invention is, as described in an eighth aspect, a drive control method for an active drive type light emitting display device in which a large number of light emitting display pixels each of which at least comprises a light emitting element and a drive TFT imparting a drive current to said light emitting element are arranged and further in which a plurality of measuring pixels each of which at least comprises a measuring element and a drive TFT imparting a drive current to said measuring element are arranged, characterized in that said drive control method for the active drive type light emitting display device executes the step of driving the measuring element constructing the measuring pixel, the step of obtaining a forward voltage of the measuring element in the measuring pixel, and the step of controlling a drive voltage applied to the light emitting display pixel based on the forward voltage.

DESCRIPTION OF THE PREFERRED EMBODIMENTS

Figure 1:
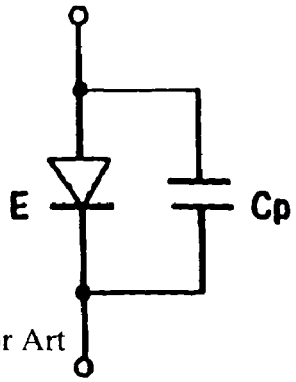
FIG. 1 is a view showing an equivalent circuit of an organic EL element.
Figure 2:
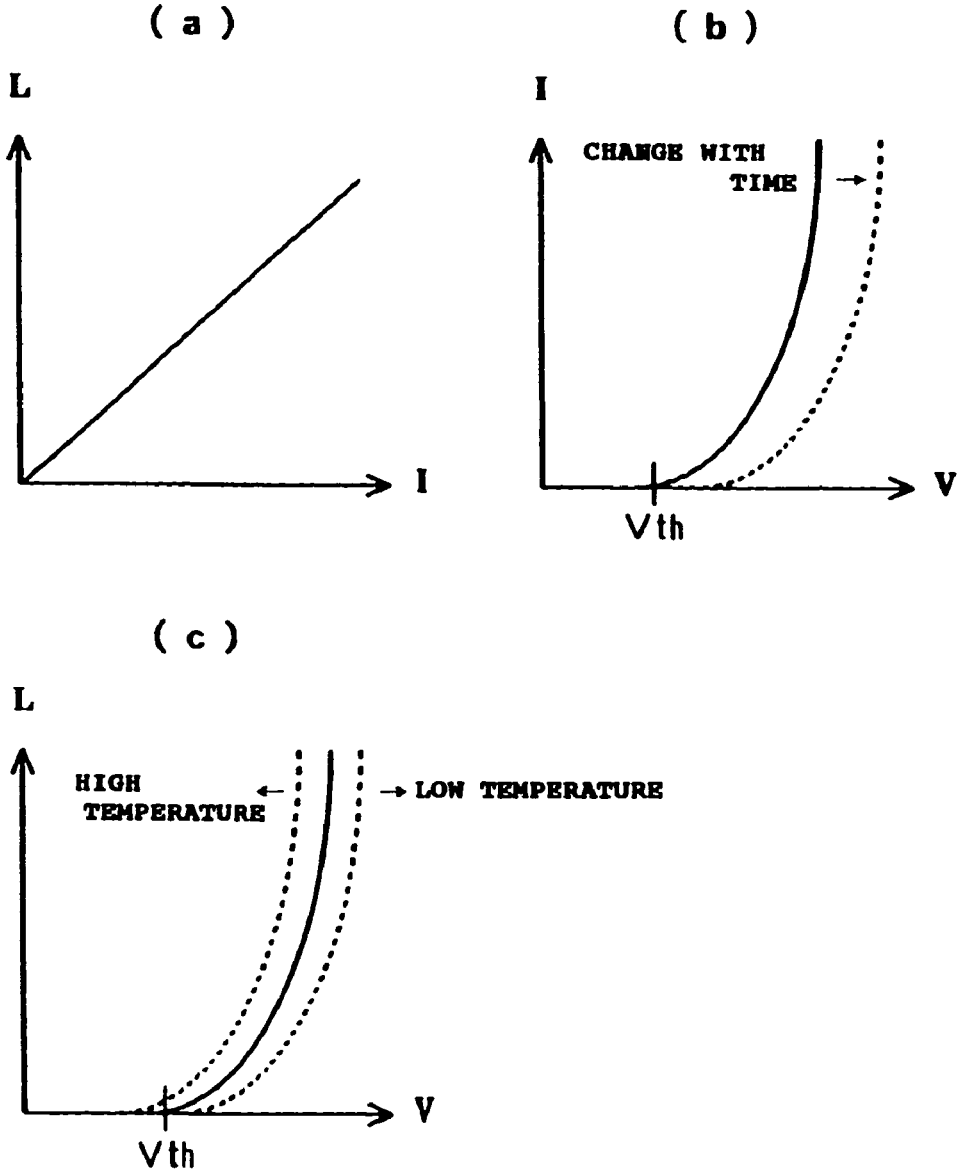
Prior Art FIG. 2
FIG. 2 is views showing the characteristics of the organic EL element.
Figure 3:
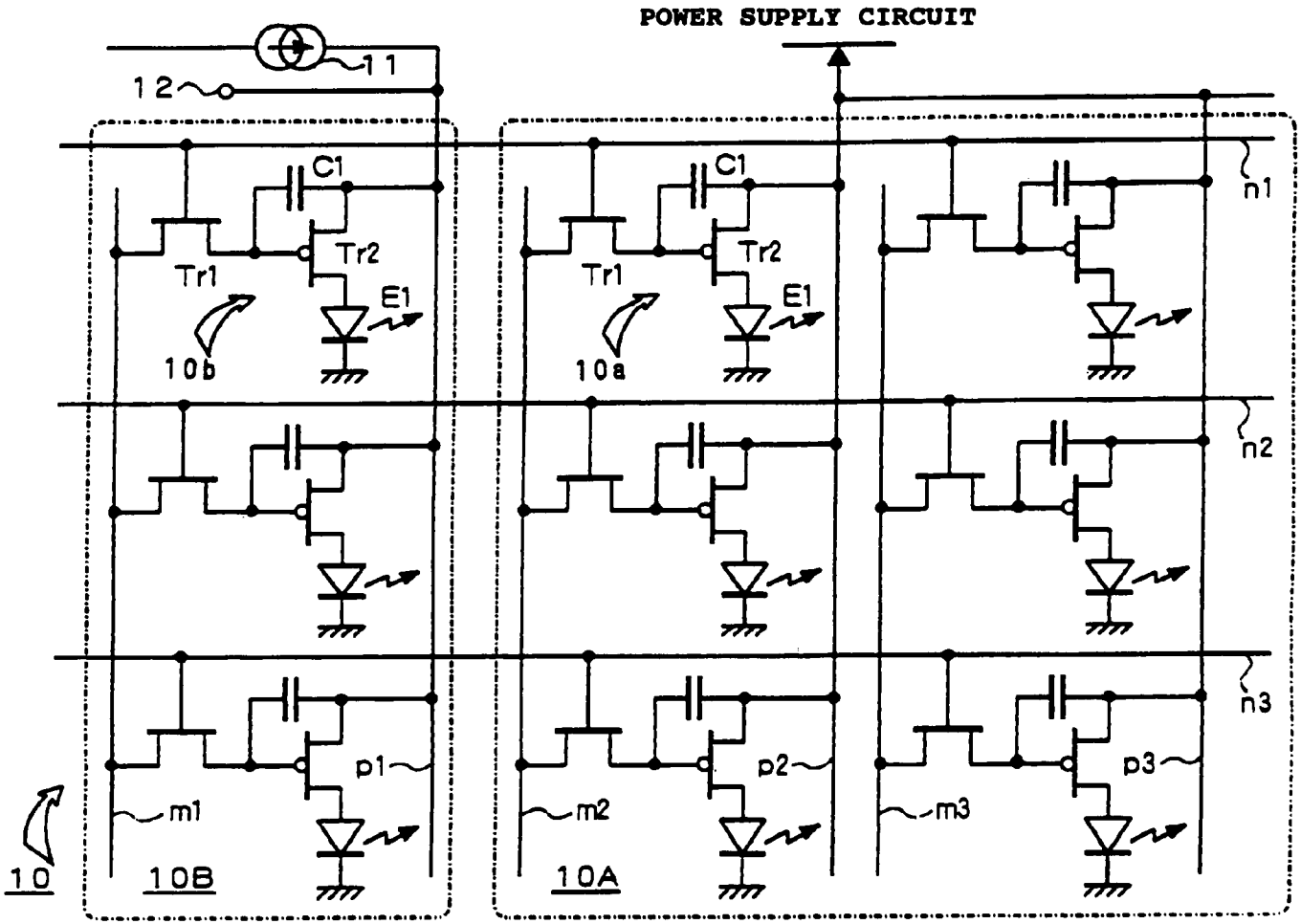
FIG. 3 is a connection diagram showing the structure of a part of a light emitting display device according to the present invention.

An active drive type light emitting display device and a drive control method thereof according to the present invention will be described below with reference to embodiments shown in the drawings. FIG. 3 mainly illustrates the structure of a part of a light emitting display device (light emitting display panel) according to the present invention. The embodiment shown in this FIG. 3 shows the state where a light emitting display area 10A in which light emitting display pixels 10*a* are arranged in a matrix pattern and a measuring pixel area 10B in which measuring pixels 10*b* are arranged in a row direction are formed on a light emitting display panel 10.

In the light emitting display panel 10, data lines m1, m2, m3, . . . from a data driver which will be described later are arranged in a vertical direction (row direction), and control lines n1, n2, n3, . . . from a scan driver which will be described later similarly are arranged in a horizontal direction (line direction). Further, in the display panel 10, power supply lines p1, p2, p3, . . . are arranged in the vertical direction corresponding to the respective data lines.

The light emitting display pixels 10*a* in the light emitting display area 10A are constructed by a conductance control technique as a typical example thereof. That is, as reference characters are assigned to respective elements constructing a pixel 10*a* on the upper left of the light emitting display area 10A, the gate of a control TFT (Tr1) comprised of N-channels is connected to the control line n1, and the source thereof is connected to the data line m2. The drain of the control TFT (Tr1) is connected to the gate of a drive TFT (Tr2) comprised of P-channels and to one terminal of a capacitor C1 provided for holding electrical charges.

The source of the drive TFT (Tr2) is connected to the other terminal of the capacitor C1 and to the power supply line p2. The anode terminal of an organic EL element E1 provided as a light emitting element is connected to the drain of the drive TFT, and the cathode terminal of this EL element E1 is connected to a reference potential (ground). Thus, a large number of light emitting display pixels 10*a* of the above-described structure are arranged in a matrix pattern in the vertical and horizontal directions in the light emitting display area 10A as described above.

The measuring pixels 10*b* in the measuring pixel area 10B are also constructed similarly to the light emitting display pixels, and the same reference characters as those of the respective elements constituting the light emitting display pixel 10*a* are assigned to the respective elements in the measuring pixel of the top thereof. The gate of the control TFT (Tr1) constructing the measuring pixel 10*b* is connected to the control line n1, and the source thereof is connected to the data line m1. The source of the drive TFT (Tr2) is connected to the power supply lines p1. The measuring pixels 10*b* are arranged forming a line along one data line m1 in the measuring pixel area 10B.

The element designated by the reference character E1 constituting the measuring pixel 10*b* will be called a measuring element. In this embodiment, the same element as the organic EL element E1 constituting the light emitting display pixel 10*a* is employed as the measuring element. Thus, in the case where the organic EL element is employed as the measuring element, when this element is driven, since the driving is accompanied by light emitting operation, it is desired that a shield film or the like which cuts off light is provided on the surface of the measuring pixel area 10B as the need arises.

The organic EL element needs not necessarily be employed as the measuring element, and measures such as that elements which do not emit light are formed in the measuring pixel area 10B can be considered. In short, other elements whose electrical characteristics including a characteristic regarding changes with time, temperature dependency, and the like are very similar to those of the organic EL element can be used as the measuring element.

As described above, in the embodiment shown in FIG. 3, the respective light emitting display pixels 10*a* are arranged in a matrix pattern at intersection point positions between the data lines and the control lines, the measuring pixels 10*b* are arranged forming a line along one data line m1, and the respective control lines utilized in these measuring pixels 10*b* and the control lines n1, n2, n3, . . . utilized in the light emitting display pixels 10*a* are shared. Accordingly, the gate voltage of the control TFT of the measuring pixel 10*b* and the gate voltage of the control TFT of the light emitting display pixel 10*a* become common, and as a result, the gate voltage of the drive TFT of the measuring pixel 10*b* and the gate voltage of the drive TFT of the light emitting display pixel 10*a* become common.

A constant current is supplied to the power supply line p1 in the measuring pixel 10*b* via a constant current source 11. A voltage detecting terminal 12 is drawn between the constant current source 11 and the respective measuring pixels 10*b*, that is, from the power supply line p1 so that the forward voltage VF of the measuring element in the measuring pixel 10*b* can be obtained at said terminal 12.

Although the structure shown in FIG. 3 shows a form in which the voltage detecting terminal 12 is particularly provided in order to obtain the forward voltage VF of the measuring element, this is for the sake of convenience in the explanation, and in reality there are cases in which for example one signal line in an IC circuit has the function of the voltage detecting terminal 12.

Meanwhile, a drive voltage from a power supply circuit constituting a constant voltage source which will be described later is supplied to the respective light emitting display pixels 10*a* via the respective power supply lines p2, p3, . . . , and by this drive voltage lighting drive of the respective EL elements E1 provided as light emitting elements are selectively carried out.

Figure 4:
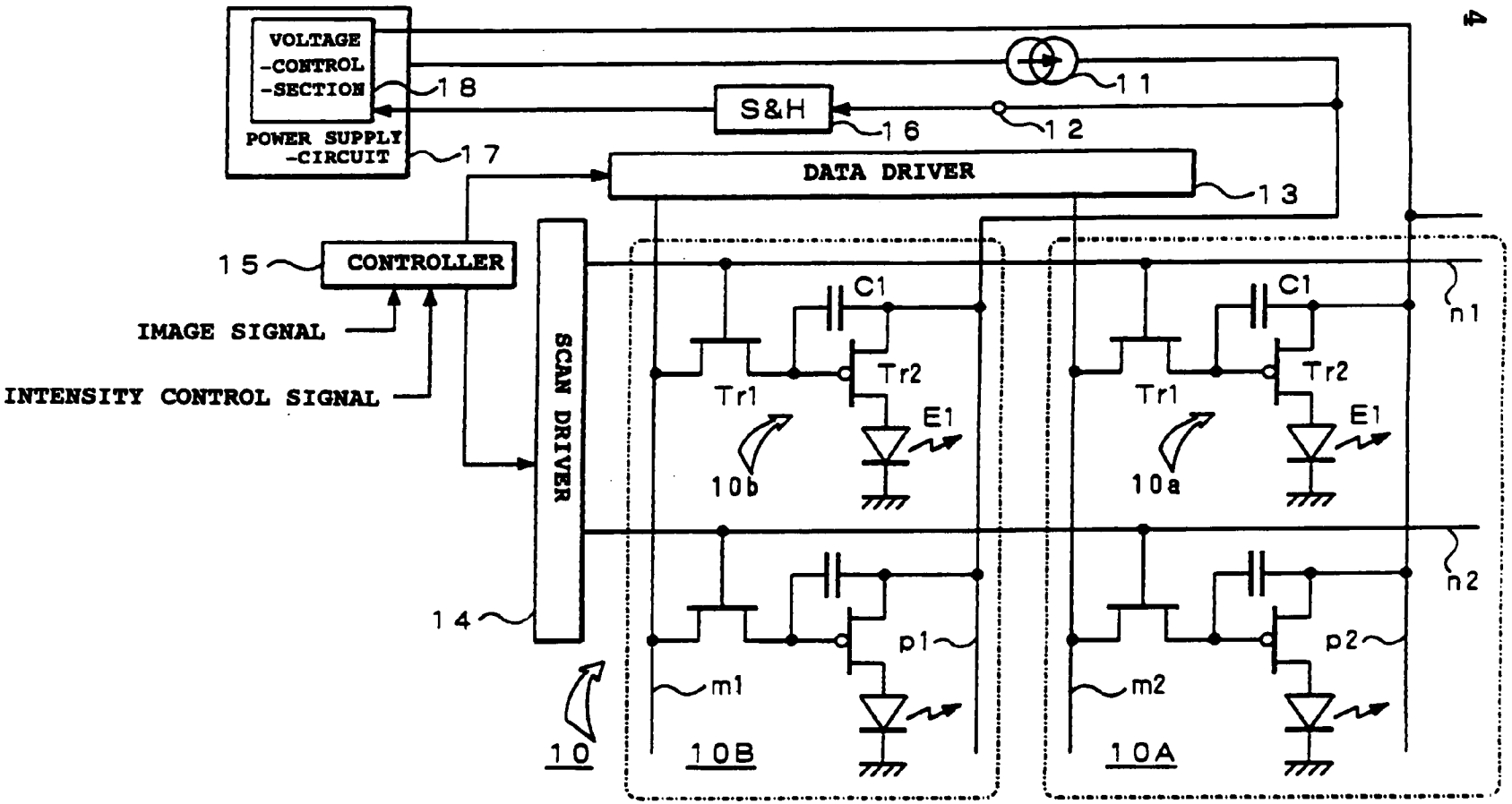
FIG. 4 is a block diagram including peripheral circuits which drive and control the display device shown in FIG. 3.

FIG. 4 shows a block structure including peripheral circuits which drive and control the light emitting display panel 10 of the above-described structure. As shown in FIG. 4, the respective data lines m1, m2, m3, . . . arranged in the vertical direction are drawn from the data driver 13, and the control lines n1, n2, n3, . . . arranged in the horizontal direction are drawn from the scan driver 14.

A control bus is connected from a controller IC 15 to the data driver 13 and to the scan driver 14, the data driver 13 and the scan driver 14 are controlled based on an image signal supplied to a controller IC, lighting drive of the respective light emitting display pixels 10*a* in the light emitting display area 10A are selectively carried out by operations described below, and as a result an image is reproduced in the light emitting display area 10A.

That is, when an ON voltage is supplied from the scan driver 14 to the gate of the control TFT (Tr1) in the light emitting display pixels 10*a* for example via the control line n1, the control TFT (Tr1) allows a current corresponding to a data voltage which is supplied from the data line m2 to the source thereof to flow from the source to the drain. Accordingly, in the period in which the gate of the control TFT (Tr1) is at the ON voltage, the capacitor C1 is charged, and its voltage is supplied to the gate of the drive TFT (Tr2). Thus, the drive TFT (Tr2) allows a current which is based on the gate voltage and the source voltage thereof to flow in the EL element E1 to drive the EL element so that the EL element emits light. That is, the drive TFT (Tr2) constant-current drives the EL element E1 so that the EL element E1 emits light.

When the gate of the control TFT (Tr1) becomes an OFF voltage, the control TFT (Tr1) becomes a so-called cutoff. Although the drain of the control TFT (Tr1) becomes in an open state, the gate voltage of the drive TFT (Tr2) is maintained by the charges accumulated in the capacitor C1, the drive TFT (Tr2) maintains the drive current until a next scan, and light emission of the EL element E1 is also maintained. A sampling/holding circuit 16 which samples and holds the voltage value VF (the forward voltage of the measuring element) which is brought to the voltage detecting terminal 12 shown in FIG. 4 is connected to the voltage detecting terminal 12. The output of the sampling/holding circuit 16 is supplied to a voltage control section 18 in a power supply circuit 17.

Here, the voltage control section 18 in the power supply circuit 17 controls the value of the constant voltage supplied to the power supply lines p2, p3, . . . in response to a hold voltage by the sampling/holding circuit 16. That is, this is carried out so that the level of the drive voltage applied to the respective light emitting display pixels 10*a* is controlled in response to the forward voltage VF brought to the voltage detecting terminal 12.

In this case, control is performed so as to increase the level of the drive voltage applied to the respective light emitting display pixels 10*a* when the forward voltage VF brought to the terminal 12 is high, and inversely control is performed so as to decrease the level of the drive voltage applied to the respective light emitting display pixels 10*a* when the forward voltage VF brought to the terminal 12 is low.

Thus, the value of the drive voltage applied to the light emitting display pixel 10*a* is controlled, and the drive TFT (Tr2) in the light emitting display pixel 10*a* can drive the EL element E1 in the state where the drop voltage (VD) of the degree by which a constant current characteristic can be ensured is ensured. In this case, since the value of the drive voltage applied to the light emitting display pixel 10*a* as well as fluctuation elements such as the variation part per hour (VL) of the forward voltage VF and the temperature change part (VT) of the VF of the EL element and the like are controlled, a power loss generated in the drive TFT (Tr2) in the light emitting display pixel 10*a* can be effectively restrained.

It is desired that the constant current source 11 in the structure shown in FIG. 4 is constructed so as to output a current of the degree which allows one measuring pixel 10*b* to emit light at a predetermined intensity. Thus, a constant current is applied to the respective measuring pixels 10*b* one after another in synchronization with the operations of lighting drive for the light emitting display pixels 10*a*. That is, control is performed so that current is not supplied from the constant current source 11 to the plurality of measuring pixels 10*b* at the same time.

By allowing the sampling/holding circuit 16 to have a time constant which is longer than the cycle by which the constant current is supplied to the measuring pixels 10*b* one after another, the forward voltage VF averaged in an analogous way in the respective measuring pixels 10*b* can be obtained at the voltage detecting terminal 12. Thus, control for the value of the drive voltage applied to the light emitting display pixels 10*a* can be performed based on the averaged voltage VF, and influence due to variations of the VF can be avoided.

Although the drive TFT (Tr2) constructing the light emitting display pixel 10*a* is operated in a saturation region at a predetermined gate voltage, it is necessary for the drive TFT (Tr2) in the measuring pixel 10*b* to be operated in a linear region as a switching element. This has a meaning that detection of the forward voltage VF in the measuring pixel 10*b* is prevented from becoming inaccurate when an ON resistance of the drive TFT in the measuring pixel 10*b* is large.

The embodiment shown in FIG. 4 is constructed in such a way that an intensity control signal is supplied to the controller IC 15 and that the light emission intensities of the respective light emitting display pixels 10*a* can be changed in response to this intensity control signal. That is, the intensity control signal is supplied to the controller IC 15 so that a control signal is sent from the controller IC 15 to the data driver 13, and the data driver 13 controls the source voltage applied to the control TFTs (Tr1) constructing the respective light emitting display pixels 10*a* based on the intensity control signal.

Thus, the gate voltages of the drive TFTs (Tr2) in the respective light emitting display pixels 10*a* are controlled, and the values of the currents supplied to the EL elements E1 in the light emitting display pixels 10*a* are changed. Therefore, as a result, the light emission intensities of the EL elements in the light emitting display pixels 10*a* are controlled. In this case, the drive current supplied to the measuring elements constituting the measuring pixels 10*b* is also controlled based on the intensity control signal.

Accordingly, with this embodiment, the current value of the constant current source 11 supplying current to the measuring pixels 10*b* is also changed by the intensity control signal. Thus, since the current flowing in the measuring element of the measuring pixel 10*b* is also changed in response to the light emission intensity (=drive current) of the light emitting element (EL element E1), the EL element E1 in the light emitting display pixel 10*a* and the measuring element in the measuring pixel 10*b* are driven under the same condition.

Therefore, the forward voltage VF of the EL element E1 in the light emitting display pixel 10*a* can be grasped by the measuring element in the measuring pixel 10*b* more accurately. Thus, restraining function for the above-mentioned power loss generated in the drive TFT (Tr2) in the light emitting display pixel 10*a* can be realized with higher accuracy.

In the embodiment described above, although the forward voltages VF obtained by the respective measuring pixels 10*b* are sampled and held and analog control for the drive voltage applied to the light emitting display pixel 10*a* is performed based on that hold value, for example it is also possible that A/D conversion for that hold value is performed to obtain digital data to control the drive voltage applied to the light emitting display pixels 10*a* based on the digital data. In the case where this structure is adopted, averaging process for the forward voltages VF can be made easy, and in the case where a part of the measuring pixels 10*b* becomes defective, processing such as stopping of obtaining the VF from a pixel which has become defective can be performed easily.

Although the embodiment explained above has been described based on the case where the structure of the conductance control technique is adopted as the light emitting display pixel 10*a*, this invention not only can be adopted in a light emitting display device of this specified structure but also can be adopted similarly in a light emitting display device in which employed is an active drive type pixel structure such as for example a voltage writing technique, a current writing technique, a drive technique of 3 TFT method which realizes digital gradation, that is, SES (Simultaneous-Erasing-Scan), a threshold voltage correction technique, and a current mirror technique, and the like.

Further, although the embodiment described above employs a structure in which electrical connection structures constructing the respective light emitting display pixels 10*a* and measuring pixels 10*b* are the same, the both structures may be different.

What is claimed is:

1. An active drive type light emitting display device in which a large number of light emitting display pixels each of which at least comprises a light emitting element and a drive TFT that allows a drive current to flow to the light emitting element are arranged, wherein the active drive type light emitting display device is constructed in such a way that a plurality of measuring pixels each of which at least comprising a measuring element and a drive TFT that allows a drive current to flow to the measuring element are further arranged in the light emitting display device so that a forward voltage of the measuring element constructing the measuring pixel can be picked up from a power supply line of the measuring pixel.

2. The active drive type light emitting display device according to claim 1, wherein the respective light emitting display pixels are arranged in a matrix pattern at intersection point positions between data lines and control lines, that the measuring pixels are arranged forming a line along one data line, and that the control lines utilized in the measuring pixels and the control lines utilized in the light emitting display pixels are shared.

3. The active drive type light emitting display device according to claim 1 or 2, wherein an operating power supply for the measuring pixels is a constant current source.

4. The active drive type light emitting display device according to claim 3, wherein the active drive type light emitting display device is constructed in such a way that the current value of the constant current source is variable.

5. The active drive type light emitting display device according to claim 4, wherein the active drive type light emitting display device is constructed in such a way that the forward voltage of the measuring element constructing the measuring pixel is obtained between the constant current source and the measuring pixel.

6. The active drive type light emitting display device according to claim 3, wherein the active drive type light emitting display device is constructed in such a way that the forward voltage of the measuring element constructing the measuring pixel is obtained between the constant current source and the measuring pixel.

7. The active drive type light emitting display device according to claim 1, wherein a power supply circuit which controls a power supply voltage applied to the light emitting display pixels based on a forward voltage obtained by the measuring element constructing the measuring pixel.

8. The active drive type light emitting display device according to claim 1, wherein at least the light emitting element in the light emitting display pixel is constituted by an organic EL element in which an organic compound is employed in a light emitting layer.

9. The active drive type light emitting display device according to claim 1, wherein the measuring element is the same kind of light emitting element as the light emitting element and that the measuring element comprise a shield which cut off light towards a display surface.

10. A drive control method for an active drive type light emitting display device in which a large number of light emitting display pixels each of which at least comprises a light emitting element and a drive TFT that allows a drive current to flow to the light emitting element are arranged and further in which a plurality of measuring pixels each of which at least comprises a measuring element and a drive TFT that allows a drive current to flow to the measuring element are arranged, wherein the drive control method for the active drive type light emitting display device executes the step of driving the measuring element constructing the measuring pixel, the step of obtaining a forward voltage of the measuring element from a power supply line of the measuring pixel, and the step of controlling a drive voltage applied to the light emitting display pixel based on the forward voltage.

11. The drive control method for the active drive type light emitting display device according to claim 10, wherein a constant current source is utilized as an operating power supply for the measuring pixels and that the current value of the constant current source is varied in response to the light emission intensity of the light emitting element.

12. The drive control method for the active drive type light emitting display device according to claim 10 or 11, wherein the drive TFT constructing the measuring pixel is operated in a linear region.

13. The drive control method for the active drive type light emitting display device according to claim 12, wherein the drive TFT constructing the light emitting display pixel is operated in a saturation region at a predetermined gate voltage.

* * * * *